United States Patent [19]

Powell

[11] 4,078,329

[45] Mar. 14, 1978

[54] SIMULATED CITIZENS BAND RADIO

[76] Inventor: James Lowell Powell, R.R. No. 1
P.O. Box 93, Cecil, Ohio 45821

[21] Appl. No.: 704,315

[22] Filed: Jul. 12, 1976

[51] Int. Cl.[2] ..... A63H 5/00

[52] U.S. Cl. ..... 46/175 AR

[58] Field of Search ..... 46/175 AR, 33, 232, 46/14, 175 R, 174, 227; 35/8 A, 35 C

[56] References Cited

U.S. PATENT DOCUMENTS

| | | | |
|---|---|---|---|
| 1,563,359 | 12/1925 | Green | 46/174 R |
| 1,569,509 | 1/1926 | Leedy | 46/174 R |
| 2,813,373 | 11/1957 | Heller | 46/227 |
| 3,120,716 | 2/1964 | Orenstein | 46/1 |
| 3,238,644 | 3/1966 | Hayes | 35/60 |
| 3,620,538 | 11/1971 | Mercer et al. | 46/117 |
| 3,636,654 | 1/1972 | Workman | 46/175 R |
| 3,636,655 | 1/1972 | Porter et al. | 46/175 AR |
| 3,702,515 | 11/1972 | Beasley et al. | 46/175 AR |
| 3,769,744 | 11/1973 | Sloane | 46/175 AR |
| 3,793,766 | 2/1974 | Moquin et al. | 46/175 AR |

FOREIGN PATENT DOCUMENTS

| | | | |
|---|---|---|---|
| 952,680 | 5/1949 | France | 46/174 R |

*Primary Examiner*—F. Barry Shay
*Attorney, Agent, or Firm*—John A. Young

[57] ABSTRACT

Simulated citizens band radio has an instrument panel simulating the working controls of a citizens band radio. A microphone fits in a cradle formed by a lever which determines a voice-transmitting-connection and deactuates the speaker mechanism until the microphone is lifted from the cradle. Thereafter, simulated CB talk can be generated by pulling a string and operating a recording which produces simulated voice transmission after the microphone is lifted from its cradle. When the microphone is replaced the voice transmission is terminated.

5 Claims, 5 Drawing Figures

FIGURE 1
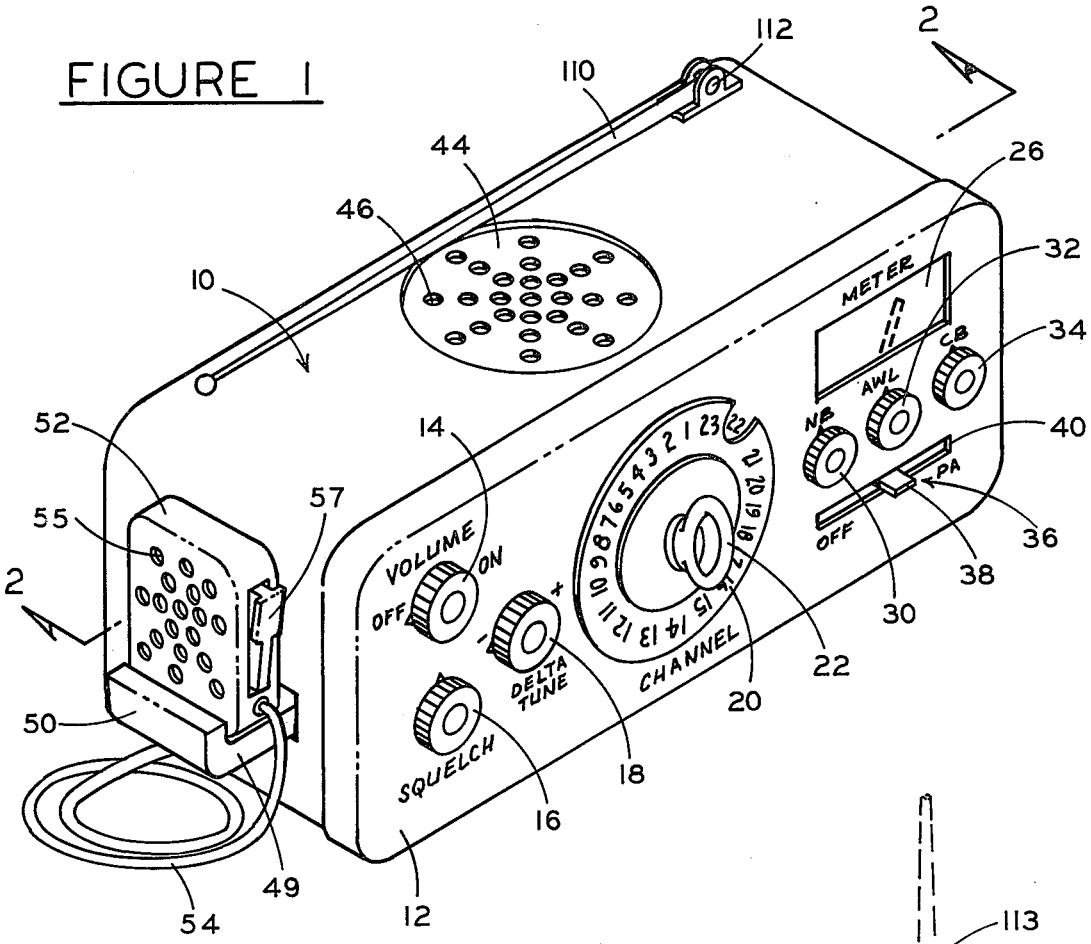
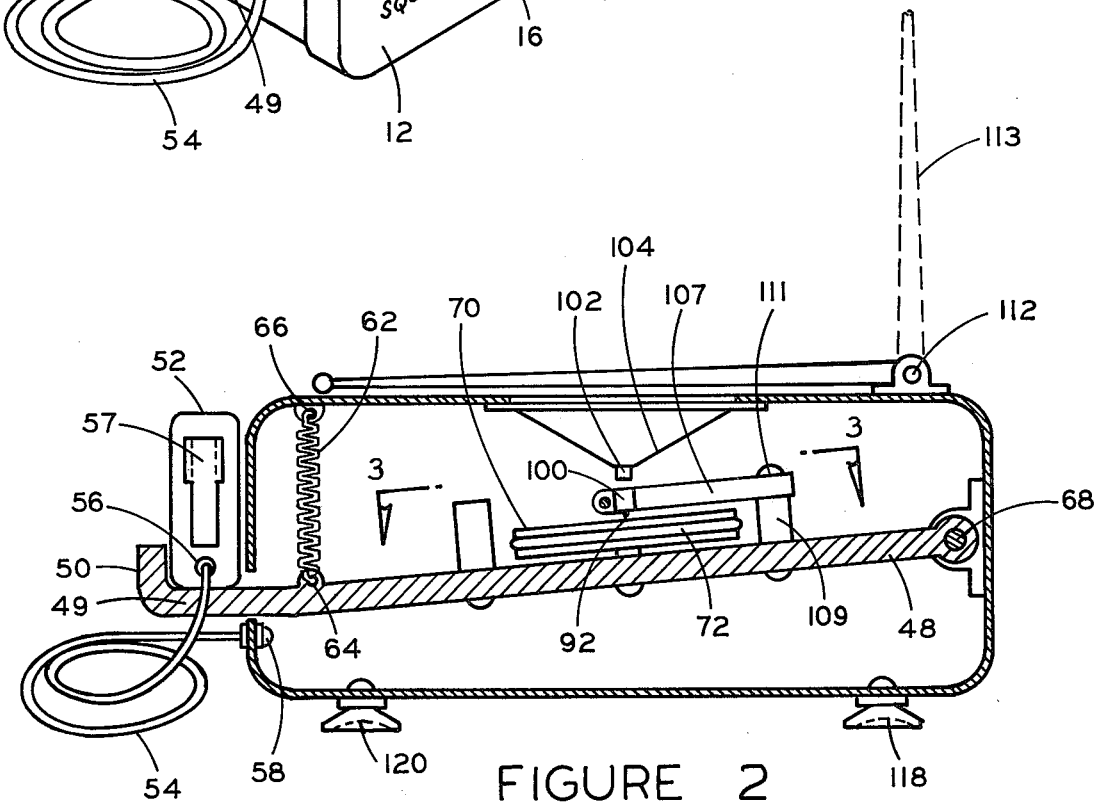
FIGURE 2

SIMULATED CITIZENS BAND RADIO

BACKGROUND OF THE INVENTION

The popularity of citizens band "CB" radio has attracted the attention of many children who would like to imitate elders in the operation and use of citizens band radio. For example, many children, deprived of a simulated citizens band, will attempt to use the adult citizens band radio for voice transmission reception. Of course, this is impractical since the equipment can be injured inadvertently by young users.

What is needed, therefore, is a citizens band toy transceiver which will simulate the various control elements of citizens band radio, and will have the external appearance of a citizens band radio, and in fact can simulate both transmission and receiving functions of a citizens band radio.

OBJECTS OF THE INVENTION

One of the principal objects of the present invention is to provide a toy citizens band radio having the appearance and simulated function of a citizens band radio, and which can be readily mounted on bicycles, tricycles, dressers, car seats, dashboards, or the like whereby children can become acquainted with the functions of a citizens band radio and simulate all of the transceiver functions.

Other objects and features of the present invention will become apparent from a consideration of the following description which proceeds with reference to the accompanying drawings.

DRAWINGS

FIG. 1 is an isometric view of a citizens band simulated transceiver;

FIG. 2 is a section view taken on Line 2—2 of FIG. 1;

DETAILED DESCRIPTION OF THE INVENTION

Figure 3:
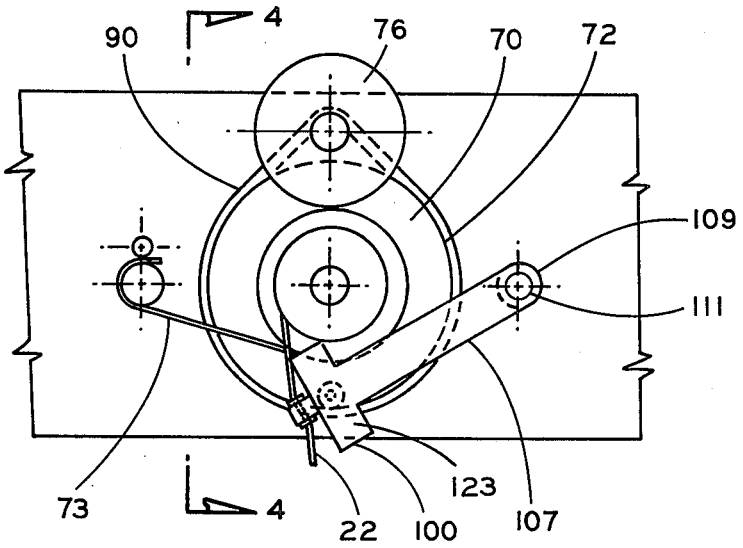
FIG. 3 is a section view taken on Line 3—3 of FIG. 2.
Figure 4:
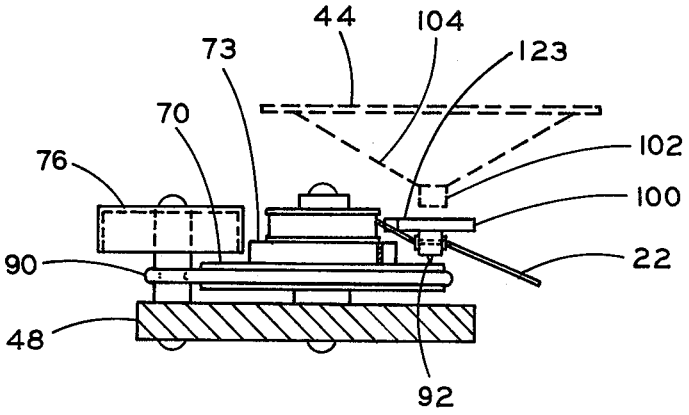
FIG. 4 is a section view taken on Line 4—4 of FIG. 3; and, FIG. 5 is an enlarged detail section view taken through the microphone.
Figure 5:
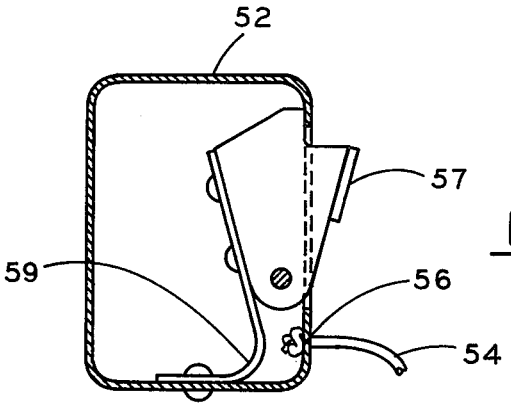

Referring to FIGS. 1 and 2, the simulated CB device designated generally by reference numeral 10 consists of a housing or cabinet 12 having various simulated citizens band controls including a volume control knob 14, squelch knob 16, delta tuner 18, a 23-channel selector 20, and pull string 22 disposed centrally of selector 20 and adapted to be pulled to simulate voice transmissions. At the right hand side of the cabinet 12 indicated in FIG. 1, are additional controls consisting of a meter 26, a noise blank control 30, AWL 32, and a citizens band or PA control 34. Below these last three simulator controls 30,32, and 34 is a fine tune controller 36 consisting of a tab 38 which is moveable back and forth within slot 40.

Above the toy unit is a speaker outlet 44 with a number opening 46 so that a record of simulated CB voice transmission can be heard. Within the device 10 is a lever 48 (FIGS. 1, 2) and the end 49 has a cradle 50 adapted to receive a small simulated microphone 52 with a cable 54 attached at 56 to the microphone and at 58 to the interior of the device 10.

The microphone 52 has a number of openings 55 which are held to the lips and a switch 57 which is depressed during voice transmission. The switch 57 is held normally in the position shown in FIG. 1 by a leaf spring, and the switch is depressed against the resistance of the spring 59.

Referring to the interior of the housing 12 (FIG. 2) is a spring 62 which is stretched between a hook 64, a lever 48 and 66 at the cabinet interior to bias the lever 48 about pivot 68 when the microphone 52 is lifted from cradle 50. The lever 48 carries with it a record 70 on turntable 72 which is rotated by winding a spring 73 effected by pulling the string 22. The record player is caused to rotate at a relatively constant speed by an inertia wheel or fly wheel 76. Fly wheel 76 and turntable 72 are held together by means of a flexible cord or the like 90. A stylus 92 enters one of a plurality of grooved helical voice screws in the record 70. Voice transmission is then effected from the stylus through a head 100 to a pickup 102 which then transmits recorder sound to speaker 44 through control speaker 104 and openings 46. The stylus 92 is mounted on arm 107 pivoted on pinion 109 at 111. Once the microphone 52 is lifted from cradle 50 the spring 62 can bias the lever 48 upwardly to engage head 100 with pickup 102, and pulling the string 22 makes it possible to generate a recording which simulates a received message. There are preprogrammed a number of such messages commonly found in CB "talk." The unit is constructed, however, so that no reception will occur until the unit is activated by first removing the microphone 52 from the cradle 50.

At the top of the unit is an antenna 110 which pivoted at 112 to the upright position indicated by dashed line 113 and the antenna is retracted by simply rotating it counterclockwise about 112 to the full line position shown in FIG. 2.

The unit is readily mounted through suction cups 118, 120 onto a flat surface, or clamps may be used in lieu of the suction cups 118, 122 enabling it to be mounted onto a handlebar or the like to a bicycle. The surface 123 of head 100 is flat so that there is only facial engagement between the contacting surface of 123 and 102, this being a prerequisite to voice transmission.

OPERATION

In operation the device 10 is mounted through one of the cups 118, 120 or equivalent clamp onto a surface such as a bicycle handle, or the like.

The user of the device 10 has available the various control knobs, levers, dials, etc. to closely approximate actual CB operation. The adjustments, operation and visual inspection are all designed to give the impression of actual CB useage.

When the operator wishes to simulate voice transmission the speaker or microphone 52 is lifted from the cradle 50, the spring 62 pulls the lever 48 upwardly pivoting about 68 and engaging the head 100 with pickup 102. When the string 22 is pulled, spring 73 is loaded, and when the string is then released, the spring 73 will rotate turntable 72 and needle 92 will enter a new groove of the record, and when the turntable 72 rotates, at constant speed determined by the flywheel 76, a voice is transmitted through speaker 44 via the closed connection between 100 and 102 effected by spring 62. Several voice transmissions can be made by successive pulls on string 22 and a voice transmission will be heard, coordinated, if desired, by speaking through microphone 52. Thus by alternately speaking into microphone 52 and pulling on string 22 for record transmission, a two-way conversation can be simulated.

An important feature of the invention, however, is that no voice transmission can be effected by the record from pulling string 22 unless the microphone 52 is first removed from the cradle 50.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims.

What I claim is:

1. A model citizens band radio comprising a housing having an instrument panel with simulated CB controls including volume, squelch, selector, noise blanker and a microphone; a lever within said housing and providing a portion extending outwardly of said housing and forming a cradle for removably receiving and supporting said microphone, a pivot mounting for said lever interiorly of said housing; means in said housing for reproducing from a recording a voice, said means including a recording player and a speaker; spring means in said housing for biasing said lever upwardly to effect a voice transmitting connection between said speaker and said recording player, means for decoupling said connection; and manually energizable means in said housing for driving said recording player including a draw string having at least an actuatable portion disposed exteriorly of said housing.

2. The model citizens band radio in accordance with claim 1 wherein said connection is a pressure-responsive voice-transmitting connection effected by said lever as it is pivoted by said spring into voice-transmitting position, said microphone being effective to bias the lever in a direction opposed by said spring to effect decoupling of the voice-transmitting connection whereby voice transmission is obtainable only with the microphone in an unseated position.

3. The model in accordance with claim 1 including an exterior antenna movable between a retracted position disposed against said housing and an extended voice-transmitting-and-receiving position.

4. The citizens band radio model in accordance with claim 1 wherein said speaker has an opening external to said housing.

5. The citizens band radio model in accordance with claim 1 said housing including a base, and spaced mounting members disposed one at each end of said base for mechanically mounting the model.

* * * * *